US006228192B1

(12) United States Patent
Neidert et al.

(10) Patent No.: US 6,228,192 B1
(45) Date of Patent: May 8, 2001

(54) DOUBLE BASE PROPELLANT CONTAINING 5-AMINOTETRAZOLE

(75) Inventors: Jamie B. Neidert, Jeffersonton; Robert S. Scheffee, Lorton; Gary T. Bowman, Warrentown; James D. Martin, Manassas, all of VA (US)

(73) Assignee: Altantic Research Corporation, Gainesville, VA (US)

( * ) Notice: Subject to any disclaimer, the term of this patent is extended or adjusted under 35 U.S.C. 154(b) by 0 days.

(21) Appl. No.: 09/294,134

(22) Filed: Apr. 20, 1999

(51) Int. Cl.[7] ..... C06B 45/10
(52) U.S. Cl. ..... 149/19.8; 149/36; 149/100
(58) Field of Search ..... 149/19.8, 100, 149/36

(56) References Cited

U.S. PATENT DOCUMENTS

| | | | | |
|---|---|---|---|---|
| 1,808,613 | * | 6/1931 | Snelling | 149/19.8 |
| 3,354,172 | | 11/1967 | Takacs . | |
| 3,489,623 | * | 1/1970 | Griffith et al. | 149/20 |
| 3,668,873 | | 6/1972 | Bauman . | |
| 3,707,411 | | 12/1972 | Gawlick et al. . | |
| 3,711,344 | * | 1/1973 | Pierce | 149/19.8 |
| 3,898,112 | | 8/1975 | Strecker et al. . | |
| 4,025,370 | * | 5/1977 | Csanady et al. | 149/100 |
| 4,029,529 | * | 6/1977 | Elrick et al. | 149/19.8 |
| 4,078,954 | * | 3/1978 | Bernardy | 149/19.8 |
| 4,298,411 | * | 11/1981 | Godsey | 149/19.4 |
| 4,315,785 | * | 2/1982 | Brodman et al. | 149/19.8 |
| 5,053,086 | | 10/1991 | Henry et al. . | |
| 5,125,684 | | 6/1992 | Cartwright . | |
| 5,254,186 | * | 10/1993 | Downes et al. | 149/19.8 |
| 5,372,664 | * | 12/1994 | Neidert et al. | 149/19.8 |
| 5,385,619 | * | 1/1995 | Downes et al. | 149/19.8 |
| 5,466,315 | * | 11/1995 | Erickson et al. | 149/36 |
| 5,500,061 | * | 3/1996 | Warren et al. | 149/19.4 |
| 5,661,261 | | 8/1997 | Ramaswamy et al. . | |
| 5,847,315 | * | 12/1998 | Katzakian et al. | 149/36 |
| 6,024,810 | * | 2/2000 | Neidert et al. | 149/19.8 |
| 6,024,812 | * | 2/2000 | Bley et al. | 149/92 |

* cited by examiner

*Primary Examiner*—Edward A. Miller
(74) *Attorney, Agent, or Firm*—Nixon & Vanderhye P.C.

(57) ABSTRACT

A family of Class 1.3 propellant compositions comprising nitrocellulose, at least one of a selected group of plasticizing nitrate esters, a thermal stabilizer, carbon and an energetic solid, and a method of making the family of propellant compositions is provided.

4 Claims, No Drawings

DOUBLE BASE PROPELLANT CONTAINING 5-AMINOTETRAZOLE

TECHNICAL FIELD

The present invention relates generally to gas generating propellant compositions and specifically to a family of energetic solid gas generating compositions useful in aerospace applications and to a method of making such compositions.

BACKGROUND ART

The development of gas generating compositions capable of optimum performance as propellants in aerospace applications has presented significant challenges. Ideal compositions must be characterized by stability, low sensitivity and an exhaust output when combusted that achieves optimum ballistic properties while producing combustion products that are compatible with system components. Such ideal gas generating compositions, moreover, should optimally be formulated from readily available, cost effective, components. Available propellant composition components have proved to be effective gas generators; however, the cost of component availability, and system compatibility have been drawbacks. Additionally, some available propellant compositions have a Class 1.1 hazards rating, which limits their utility in aerospace and similar applications where highly sensitive compositions are not desirable. Most highly filled solid rocket propellants, moreover, have limited working lives, in part because of processing methods that produce higher than desired end of mix viscosities.

The prior art has proposed a number of propellant compositions useful as rocket fuels and the like. U.S. Pat. No. 5,053,086 to Henry et al., for example, discloses a liquid castable gas generant composition useful as a solid rocket propellant formed from a high nitrogen content solid and an energetic polymer. The high nitrogen content solid may be one of several disclosed tetrazole and bitetrazole compounds, and the energetic polymers are liquid curable rubbers, with several oxetane copolymers preferred. The Henry et al. composition is stated to produce higher burn rates, on the order of 0.23 to 0.66 in/sec at 1000 psia, and flame temperatures of 1901° to 2291° F.

In U.S. Pat. No. 3,898,112, Strecker et al. disclose a solid gas generating propellant that produces total pressure immediately when the guidance of a missile is dependent on instantaneous total pressurization. This composition incorporates 75 to 87% 5-aminotetrazole nitrate in a block copolymer binder, preferably styrene-butadiene-styrene or styrene-isoprene-styrene, with optional antioxidants and plasticizing agents. An exemplary formulation produces a burning rate of 0.420 in/sec at 1000 psi and 77° F.

The propellant composition described in U.S. Pat. No. 3,354,172 by Takaes is composed of triamino-guanidinium 5-amino-tetrazolate, an oxidizer, and a binder. This composition, which is disclosed to be characterized by high stability and to have a large gas- forming capability, includes conventional oxidizers and a binder such as nitrocellulose and can include fuels such as aluminum, beryllium and boron.

U.S. Pat. No. 3,668,873 to Bauman discloses rocket propellant systems that provide thrust by employing a highly exothermic reaction of nitridable inorganic fuels and an oxidizing nitrogen source, such as 5-amino tetrazole.

Gawlick et al. in U.S. Pat. No. 3,707,411, discloses a solid propellant that includes a mixture of nitrocellulose and 5 to 80% by weight of a percussion-sensitive diazo, triazole or tetrazole derivative, such as 5-aminotetrazole. The brisance of the mixture can be varied by including explosive nitrated esters. This propellant is disclosed to be useful for annular caseless propellant cartridges, for example, stud driving tools, in which an explosive action is desired.

Gas generating compositions containing 5-aminotetrazole and an oxidizer and a nitrogen gas-producing energetic compound, an oxidizer salt and a cellulose-based binder are disclosed, respectively, in U.S. Pat. No. 5,661,261 to Ramaswamy et al. and U.S. Pat. No. 5,125,684 to Cartwright. However, the compositions described in these patents are intended for use in automotive air bags and are formulated to respond to specific functional considerations that are distinctly different from those in aerospace and similar applications.

The prior art, therefore, has failed to disclose a family of gas generating compositions useful as propellants in aerospace applications that has a stable component formulation characterized by low sensitivity, a flame temperature less than 3050° F., combustion exhaust products with optimum system compatibility, optimum ballistic properties and increased working life, and that can be formulated cost effectively from available components. The prior art has further failed to disclose a method for making a family of gas generating compositions that produces compositions with improved working lives and mechanical properties. A need exists for such a family of compositions and method for making them.

SUMMARY OF THE INVENTION

It is a primary object of the present invention, therefore, to provide a family of gas generating compositions useful for aerospace and like applications and a method of producing such compositions that overcome the disadvantages of the prior art.

It is another object of the present invention to provide a family of propellant compositions characterized by low sensitivity, a flame temperature less than 3050° F, combustion exhaust products with optimum system compatibility and optimum ballistic properties that can be formulated from low cost, sustainable components.

It is a further object of the present invention to provide a family of Class 1.3 gas generating compositions with a maximum flame temperature of 3050° F. and an acceptable exhaust output $CO/CO_2$ ratio.

It is yet another object of the present invention to provide a family of propellant compositions that is thermally stable, moisture impermeable, has an optimum working life, and has mechanical properties compatible with a cartridge-loaded end burner.

It is yet a further object of the present invention to provide a family of propellant compositions that exhibit stable combustion at relatively low pressures to produce combustion products that are substantially free of particulates, HCl and HF.

It is still another object of the present invention to provide a method for making a family of propellant compositions employing processing viscosities at levels the result in increased propellant working life.

It is a still further object of the present invention to provide a method for making a family of propellant compositions that can be conducted at low temperatures in standard mixing equipment.

It is yet another objective of the present invention 30 to provide a family of propellant compositions that does not rely on crosslinking to achieve physical integrity.

Other objects and advantages will be apparent from the following Detailed Description and claims.

In accordance with the aforesaid objects, a family of low sensitivity, stable propellant compositions that generate combustion gas with optimum system compatibility and ballistic properties suitable for aerospace and like applications is provided.

The family of propellant compositions of the present invention are formulated from an energetic solid in a double base high energy binder. The preferred energetic solids are 5-aminotetrazole and analogs of 5-aminotetrazole. The double base high energy binder preferably comprises a combination of nitrocellulose plasticized with at least one of a selected group of nitrate ester plasticizers. Carbon and a thermal stabilizer that scavenges nitrous acid are further preferred components of the present family of propellant compositions. The preferred propellant formulation is a Class 1.3 composition with a flame temperature less than 3050° F., a $CO/CO_2$ ratio greater than 8 and stable combustion properties. Further, in accordance with the present invention, a method for making a family of propellant compositions is provided. This process comprises the steps of adding nitrocellulose to a selected nitrate ester plasticizer with a thermal stabilizer, adding carbon and an energetic solid, mixing the mixture at a temperature that is sufficiently low to maintain the homogeneity of the mixture while allowing the viscosity to reach about 1.0 kP, and allowing the mixture to cure.

DETAILED DESCRIPTION OF THE INVENTION

The family of gas generator propellants of the present invention was developed to replace a currently used highly effective aerospace applications propellant with a formulation that includes components which are more costly than desired and not guaranteed to be readily available. In addition, this propellant has a Class 1.1 hazards rating and, therefore, is highly sensitive and must be handled carefully to avoid detonation. The propellant composition of the present invention has been specifically formulated to avoid these disadvantages.

The primary objective of the inventors of the present invention was to produce a family of Class 1.3 propellant formulations based on low cost, sustainable ingredients.

Other main objections for the present family of gas generating compositions included acceptable processing properties, a maximum flame temperature of 3050° F., combustion products compatible with system hardware such as valves, and ballistic properties comparable to the currently used Class 1.1 propellant. In addition, the inventors sought to develop a propellant composition with mechanical properties consistent with a cartridge loaded end burner design likely to be used, moisture impermeability, optimum thermal stability and aging properties consistent with a 40 year shelf life.

The family of propellant compositions of the present invention achieves all of the foregoing goals. These unique formulations are Class 1.3 compositions characterized by low sensitivity and a less violent response to stimuli than the Class 1.1 propellant they were designed to replace. The family of gas generating compositions of the present invention employs a double base binder composed of nitrocellulose plasticized with at least one of a selected group of nitrate esters, preferably a blend of two or more nitrate esters. A blend of high energy nitrate esters is selected to maintain the flame temperature at about 3000° F. Maintenance of the flame temperature at about 3000° F., but below 3050° F., is critical to the operation of the gas generating composition. Exemplary nitrate ester plasticizers suitable for this purpose include triethyleneglycol dinitrate (TEGDN), butanetriol trinitrate (BTTN), diethyleneglycol dinitrate (DEGDN), trimethyloltrinitrate (TMETN), nitroglycerin (NG), liquid analogs of nitroglycerin, butylnitrate ester nitramine (butyl NENA) and the inert plasticizer, triacetin (TA). Preferred nitrate ester plasticizers are butanetriol trinitrate (BTTN), triethyleneglycol dinitrate (TEGDN) as well as the inert plasticizer, triacetin (TA).

The propellant formulation of the present invention incorporates an energetic solid with the plastisol nitrocellulose (PNC). 5-aminotetrazole (5-AT) was found both to increase the $CO/C0_2$ ratio of the combustion products and to improve the ballistic properties and ignitability of the propellant. The incorporation of 5-AT into the nitrocellulose-nitrate ester plasticizer, moreover, reinforces the mechanical properties without sensitizing the propellant formulations of the present invention to shock detonation stimuli. Although anhydrous 5-aminotetrazole is preferred for this purpose, analogs of 5-AT may also be included in the present propellant compositions. Exemplary analogs of 5-AT that may be utilized in these compositions are 5-aminotetrazole monohydrate, 5-amino-1H-tetrazole, 5,5'-bi-1H-tetrazole diamonium salt (ABT). In addition, oxamides, such as cyanoguanidine or dicyandiamide, oxamide, melamine, ammonium, nitrate, and guanidine nitrates, such as guanidine nitrate and aminoguanidine nitrate may be used in place of 5-AT as the energetic solid in the present propellant. The amount and particle size of the 5-AT or equivalent energetic solid is important. The burning rate can be significantly increased by using a smaller particle size energetic solid. Particle sizes of approximately 200–300 micrometers are preferred.

Carbon has been determined to function very effectively to modulate the burning rate with the double base formulation of the present invention by increasing the surface area. A small amount of carbon, preferably in the form of carbon black, therefore, is included in this formulation.

A thermal stabilizer that scavenges nitrous acid is also preferably included in the present propellant formulation. A preferred thermal stabilizer is para-N- methylnitroaniline (MNA). Other thermal stabilizers that fulfill this purpose include 2-nitro-phenylamine (2-NPA), 4-nitrodiphenylamine (4-NDPA) and diphenylamine (DPA).

The relative amounts of the components of the propellant formulation of the present invention should preferably be as follows:

| | |
|---|---|
| nitrocellulose | 15 to 40 weight % |
| nitrate esters | 20 to 50 weight % |
| energetic solid | 5 to 35 weight % |
| carbon | 0.1 to 1.5 weight % |
| thermal stabilizer | 0.5 to 2.5 weight % |

The relative amounts of these components will vary, depending, in part, on which nitrate esters, energetic solid and thermal stabilizer are selected for a specific formulation. A wide range of effective combinations of nitrocellulose, nitrate esters, energetic solids, burning rate modulators and thermal scavengers are contemplated to produce effective propellant compositions in accordance with the present invention.

Processing for the family of propellants of the present invention is advantageous and unique. Most highly filled solid rocket propellants exhibit end-of-mix viscosities (EOMV) that range from 2.0 to 10.0 kilopoise (kP) and have finite effective working lives or potlives. The present family of plastisol formulations does not rely on classic crosslinking, such as that exhibited by epoxy or polyurethane binders, to achieve physical integrity. Plastisol nitrocellulose (PNC) behaves as a thermoplastic; hydrogen bonding and intrinsic viscosity provide the physical integrity for the final product. The nitrocellulose is added to a selected blend of nitrate esters in a liquid form with a thermal stabilizer, such as N-methylnitroaniline (MNA). Carbon, preferably in the form of carbon black, and the necessary complement of 5-aminotetrazole (5-AT) are added to this blend.

The mixture is mixed at a temperature within the range of 60 to 80° F. until an optimum viscosity is attained. Ideally, the viscosity should be about 1.0 kP, preferably from 0.4 to 2.0 kP, to maintain the homogeneity of the mixture and to preclude settling of solid additives. High viscosity nitrocellulose pastes are not required to achieve the high levels of PNC required for the present propellant formulation. The present PNC mixtures can be processed in standard vertical mixer equipment. The flexibility of this processing method, moreover, allows for unplanned interruptions of the process without waste. These liquid nitrate esters, such as nitroglycerin (NG), butanetriol trinitrate (BTTN), trimethyloltrinitrate (TMETN), triethyleneglycol trinitrate (TEGDN) and diethyleneglycol dinitrate (DEGDN), are preferably mixed with an inert plasticizer, preferably triacetin (TA), to produce a solvent-less slurry.

This slurry maintains its flow properties, provided that the processing temperatures are maintained below 100° F. Processing temperatures of 60 to 80° F. are 25 preferred. The slurry viscosity will show little increase unless temperatures higher than 100° F. are achieved and maintained. The resulting composition is then cured. Once the compositions of the present invention cure, the resultant propellants exhibit exceptional mechanical properties.

More than one hundred propellant mixtures were investigated to ascertain such formulation parameters as nitrocellulose level, nitrate ester levels, nitrate ester blends and use of inert binder components and solid additives. The results of the investigations of four exemplary formulations are set forth below. Formulations A, B, C and D were prepared in accordance with the method of the present invention wherein nitrocellulose (NC) was added to the selected nitrate ester blend with a thermal stabilizer, here MNA. To this blend was added carbon and 5-AT. Processing took place in a vertical mixer at a temperature maintained below 100° F. at 75° F. The formulation components are expressed in weight %.

| | |
|---|---|
| FORMULATION A | |
| NC | 22.2% |
| BTTN | 21.9% |
| TEGDN | 22.2% |
| MNA | 0.6% |
| 5-AT | 33.0% |
| Carbon | 0.1% |
| FORMULATION B | |
| NC | 25.0% |
| BTTN | 32.7% |
| TEGDN | 13.4% |
| Triacetin | 7.8% |

-continued

| | |
|---|---|
| MNA | 1.0% |
| 5-AT | 20.0% |
| Carbon | 0.1% |
| FORMULATION C | |
| NC | 35.0% |
| BTTN | 24.2% |
| TEGDN | 13.6% |
| Triacetin | 5.1% |
| MNA | 2.0% |
| 5-AT | 20.0% |
| Carbon | 0.1% |
| FORMULATION D | |
| NC | 35.0% |
| BTTN | 33.4% |
| Triacetin | 9.5% |
| MNA | 2.0% |
| 5-AT | 20.0% |
| Carbon | 0.1% |

Table I sets forth the results of tests conducted on the burning rate and mechanical properties of Formulations A, B, C and D.

TABLE I

| Formulation | A | B | C | D |
|---|---|---|---|---|
| NC, % | 22.2 | 25 | 35 | 35 |
| Plasticizers | BTTN/ TEGDN | BTTN/ TEGDN/TA | BTTN/ TEGDN/TA | BTTN/ TA |
| 5-AT, % | 33 | 20 | 20 | 20 |
| $T_c$ (°F.) | 3001 | 2998 | 3000 | 3000 |
| $CO/CO_2$ | 13.9 | 9.2 | 9.5 | 8.9 |
| Rate at 480 | 0.15 | 0.12 | 0.13 | 0.11 |
| psi, in/sec | 0.60 | 0.73 | 0.62 | 0.73 |
| n | | | | |
| Card Gap | +35/−45 | +22/−25 | Not Tested | +30/−33 |
| E,psi | 795 (Tan) | 80 (Tan) | 423-Sec 2.5% | 347-Sec 2.5% |
| o/E | 0.09 | 0.26 | 0.35 | 0.45 |
| Sample type | Class A/C | Class B | Class B | Class B |
| Potlife, hr. | >10 | >10 | >10 | >20 |

The flame temperature ($T_c$) for all formulations is less than 3050° F. The $CO/CO_2$ ratios range from 8.9 for Formulation D to 13.9 for Formulation A. These ratios are sufficient to achieve stable combustion at pressures less than 100 psia. The burning rate data expressed at 480 psi, is within the desired parameters for this type of propellant formulation and indicates stable combustion. The NOL Card Gap tests indicate that the formulations tested all rated less than 70 cards and are Class 1.3 compositions. The results of the Card Gap tests clearly indicate that the propellants of the present invention are less sensitive to detonation stimuli than the currently available Class 1.1 propellants. The mechanical properties, specifically modulus, stress and strain are exceptional for a non-crosslinked propellant system. The working life or potlife of the propellant compositions of the present invention are still being evaluated. The potlife data determined thus far indicates that the propellants of the present invention will maintain processibility in production. Formulation D, which contains no TEGDN, demonstrated a significantly improved potlife as compared to the estimated end of potlife for the other formulations. The end of potlife was estimated to occur when the viscosity of the propellant mix exceeded 10 kP after production of the propellant mixture.

Table II sets forth the results of test conducted on the burning rate and mechanical properties of additional Formulations E, F, G and H which are designed to exhibit a flame temperature of about 3600° F. and are functional analogs to Formulations A, B, C and D.

TABLE II

| Formulation | E | F | G | H |
|---|---|---|---|---|
| NC, % | 37.5 | 37.5 | 37.5 | 35.0 |
| BTTN, % | 46.3 | 44.9 | 43.5 | 36.1 |
| Triacetin, % | 11.6 | 10.5 | 9.4 | 11.8 |
| MNA, % | 2.0 | 2.0 | 2.0 | 2.0 |
| C, % | 0.1 | 0.1 | 0.1 | 0.1 |
| 5-AT, % | 2.5 | 5.0 | 7.5 | |
| AN, % | | | | 15 |
| $T_c$ (°F.) | 3599 | 3598 | 3596 | 3604 |
| $CO/CO_2$ | 5.0 | 5.2 | 5.4 | 3.3 |
| Rate at 500 psi, in/sec n | 0.11 | 0.12 | 0.12 | 0.11 |
| 70° Stress, psi | | 246 | | 196 |
| Strain, % | | 180 | | 190 |
| Modulus, psi | | 272 | | 189 |

The propellant compositions of the present invention provide Class 0 1.3 compositions based on low cost sustainable components that perform with the ballistic properties required in systems employing propellants or gas generators. These propellants, moreover, are thermally stable, moisture impermeable compositions with desirable working lives and mechanical properties that are compatible with the physical components of the systems in which they are most likely to be used.

Industrial Applicability

The gas generator propellant compositions of the present invention will find their primary use in aerospace applications. However, other commercial applications for the gas generators of the present invention are contemplated, including, for example, in gas turbine engine starter cartridges. The low sensitivity and optimum burning rates of these compositions will also make them suitable for a variety of applications.

What is claimed is:

1. A propellant composition, comprising 33.0% 5-aminotetrazole, 22.2% nitrocellulose, 21.9% butanetriol trinitrate, 22.2% triethyleneglycol dinitrate, 0.6% para-N-methyl-nitroaniline and 0.1% carbon.

2. A propellant composition, comprising 20.0% 5-aminotetrazole, 25.0% nitrocellulose, 32.2% butanetriol trinitrate, 13.4% triethyleneglycol dinitrate, 7.8% triacetin, 1.0% para-N-methylnitroaniline and 0.1% carbon.

3. A propellant composition, comprising 20.0% 5-aminotetrazole, 35.0% nitrocellulose, 24.2% butanetriol trinitrate, 13.6% triethyleneglycol dinitrate, 5.1% triacetin, 2.0% para-N-methylnitroaniline and 0.1% carbon.

4. A propellant composition, comprising 20.0% 5-aminotetrazole, 35.0% nitrocellulose 33.4% butanetriol trinitrate, 9.5% triacetin, 2.0% para-N-methylnitroaniline, and 0.1% carbon.

* * * * *

UNITED STATES PATENT AND TRADEMARK OFFICE

CERTIFICATE OF CORRECTION

PATENT NO. : 6,228,192 B1
DATED : May 8, 2001
INVENTOR(S) : Jamie B. Neidert et al.

It is certified that error appears in the above-identified patent and that said Letters Patent is hereby corrected as shown below:

Title page,
Item [75], Inventors, change "Warrentown" to: -- Warrenton --;

Column 2,
Line 65, delete the number "30";

Column 3,
Line 33, delete "a" after the word "replace";
Line 34, change "propellant" to -- propellants --;

Column 4,
Line 7, change "butyl NENA" to -- N-Butyl-2-Nitrato Ethyl Nitramine --;
Line 26, delete the comma (,) between "dicyandiamide" and "oxamide";
Line 27, delete the comma (,) between "ammonium" and 'nitrate";
Line 41, after "nitrous acid" add -- during thermal degradation --;
Line 43, delete "fulfill this purpose" and substitute -- could be used --';

Column 6,
Line 37, TABLE I, change E,psi to -- Ë,psi --;
Lines 54-56, delete "The working life or potlife of the propellant compositions of the present invention are still being evaluated."
Line 57, delete "determined thus far" and change "indicates" to -- indicate --;
Line 63, delete "after production of the propellant mixture"; and Column 7,
Line 23, delete "0" after the word "Class".

Signed and Sealed this

Fourth Day of December, 2001

*Attest:*

Nicholas P. Godici

*Attesting Officer*

NICHOLAS P. GODICI
*Acting Director of the United States Patent and Trademark Office*